US005094178A

United States Patent [19]

Watkins

[11] Patent Number: 5,094,178

[45] Date of Patent: Mar. 10, 1992

[54] METHOD AND APPARATUS FOR TUFTING ACCENT YARNS IN PATTERNED PILE FABRIC

[75] Inventor: Charles W. Watkins, Ooltewah, Tenn.

[73] Assignee: Tuftco Corporation, Chattanooga, Tenn.

[21] Appl. No.: 498,977

[22] Filed: Mar. 22, 1990

[51] Int. Cl.[5] ..... D05C 15/32

[52] U.S. Cl. ..... 112/80.73; 112/25; 112/410; 112/266.2

[58] Field of Search ..... 112/7, 9, 25, 80.01, 112/80.42, 80.43, 80.54, 80.73, 266.1, 266.2, 121.16, 410

[56] References Cited

U.S. PATENT DOCUMENTS

| | | | |
|---|---|---|---|
| 3,067,701 | 12/1962 | Wilcox | 112/80.73 X |
| 3,075,482 | 1/1963 | Card | 112/80.73 X |
| 3,103,903 | 9/1963 | Broadrick et al. | 112/80.73 |
| 3,605,660 | 9/1971 | Short | 112/80.73 |
| 3,906,876 | 9/1975 | Fitton | 112/80.73 |
| 4,109,593 | 8/1978 | Barnes et al. | 112/80.73 X |
| 4,151,805 | 5/1979 | Long et al. | 112/80.01 X |
| 4,221,317 | 9/1980 | Fukada et al. | 112/80.73 X |
| 4,864,946 | 9/1989 | Watkins | 112/80.73 |

FOREIGN PATENT DOCUMENTS

| | | | |
|---|---|---|---|
| 2216553 | 10/1989 | United Kingdom | 112/80.01 |

*Primary Examiner*—Werner H. Schroeder
*Assistant Examiner*—Ismael Izaguirre
*Attorney, Agent, or Firm*—Harrington A. Lackey

[57] ABSTRACT

A method and apparatus for forming high accent pile loops at spaced intervals in a tufted pile fabric. The apparatus for carrying out this method includes separate yarn feed rolls for being selectively driven at a high speed, a low speed, and a minimal speed, by a pattern control mechanism for selectively forming regular high pile loops and low pile loops and also for braking the loops in a single row in order to produce sequentially pile loops of minimal height followed immediately by accent pile loops of heights at least as great as the regular high pile loops, and then by additional minimal height pile loops.

10 Claims, 3 Drawing Sheets

PATTERN CONTROL MECHANISM

METHOD AND APPARATUS FOR TUFTING ACCENT YARNS IN PATTERNED PILE FABRIC

BACKGROUND OF THE INVENTION

This invention relates to a method and apparatus for tufting accent yarns in a patterned pile fabric, and more particularly to a method and apparatus for tufting clearly defined accent yarns in patterned pile fabrics.

Heretofore, in the formation of accent yarns in a tufted pile fabric, the accent yarn, usually of a different color from the surrounding field of pile fabric, forms periodic high pile contrasting with low pile in the same row of stitching. Sometimes the high pile accent tufts contrast with low pile in rows extending transversely of the accent yarn. However, the high pile accent tufts are of the same height as the surrounding field of high pile. Moreover, in attempting to form high pile accent loops in a single row of stitching, because of the inertia in the yarn feed rolls and the clutch mechanisms, the transition between the low and the high pile loops is usually gradual, thereby precluding any sharp or well-defined distinction between the high pile accent tufts and the surrounding field of the pile fabric. In normal situations where the high pile accent loop is formed conventionally, there is usually a cluster of high pile loops, in which the middle accent pile loop is higher than the flanking high pile loops, because of the gradual transition between the low loops and the high loops in the same row of accent yarn stitching.

It is known in the art to operate a yarn feed roll at a speed which would pull out all the pile and produce only a back stitch which would float across the back of the base fabric.

It is also known in the art to tuft pile fabric having three different pile heights, such as disclosed in the prior R. T. Card U.S. Pat. No. 3,075,482, issued Jan. 29, 1963.

It is also known in the mechanical arts to use a clutch brake arrangement which selectively drives a shaft when the clutch is energized and alternately to stop the shaft when the brake portion is energized.

Prior U.S. Pat. No. 4,864,946 issued to the applicant on Sept. 12, 1989, and owned by the common Assignee of this application, discloses a "Yarn Feed Split Roll Apparatus For Tufting Machine" in which a plurality of drive shafts are provided for being driven at selectively different speeds in order to selectively drive various sets of yarn feed rolls at either a high speed or a low speed in accordance with a predetermined pattern control mechanism, in order to produce tufted pile fabrics of two levels, namely, high pile and low pile.

SUMMARY OF THE INVENTION

It is therefore an object of this invention to provide a method and apparatus forming a well-defined high pile accent tuft or tuft cluster in a tufted pile fabric in which the high pile accent tufts are clearly visible and sharply delineated from the normal high pile loops in the pile fabric in order to present a more well-defined accent yarn at selective intervals in the pile fabric, and to prevent fade-out of the accent tufts across the width of the tufted fabric.

A further object of this invention is to provide in a tufted pile fabric a cluster of high pile accent tufts in which each of the accent tufts is of substantially uniform height, at least as high as the normal high pile loops in the background field of the tufted pile fabric.

A further object of this invention is to provide a method and apparatus for forming well-defined high accent loops in selected longitudinal rows of stitching in a tufted pile fabric in which the loop pile formed immediately before and after the accent pile loop are formed at extremely low or minimal levels lower than the normal loop pile formed in the fabric.

A further object of this invention is to form well-defined high accent loop pile in a tufted pile fabric incorporating both normal high and low loop pile, in which the yarn in the row forming the accent loop or cluster is braked during the formation of the pile loops immediately before and immediately after the formation of the high pile accent loop or cluster.

Another object of this invention is to provide an apparatus for forming high accent pile loops at predetermined intervals in spaced longitudinal rows of stitching in a tufted pile fabric incorporating a pattern-controlled drive mechanism for driving the various sets of yarn feed rolls selectively at four different speeds in order to form the normal low loop pile, the normal high loop pile and an accent loop or loop clusters containing slightly more yarn than the normal high pile, preceded and succeeded in the same row of stitching by minimal loops lower than the normal low loop pile.

Another object of this invention is to provide an apparatus for forming patterened tufted pile fabrics of high pile tufts and low pile tufts, incorporating a yarn feed drive mechanism for over-feeding accent yarns to periodically form high pile accent tufts at least as high as the normal high pile, and to brake the accent yarn immediately preceding and succeeding the over-feeding of the accent yarn in order to form minimal loops, lower than the normal low-loop, which flank the high pile accent tufts.

Another object of this invention is to provide a method and apparatus for forming tufted pile fabrics of either loop pile or cut pile in which a variety of patterns may be formed in the tufted pile fabric in which high pile accent tufts are prominent and contrast with a high pile background field.

A further object of this invention is to provide an apparatus particularly for tufting accent yarns in a tufted pile fabric incorporating a plurality of sets of pattern-controlled yarn feed rolls, each set of feed rolls being operatively connected to a corresponding drive shaft, each drive shaft being provided with a high speed clutch, a low speed clutch, and a minimal speed or braked clutch, and an over-feed mechanism for at least one of the high speed clutches.

DESCRIPTION OF THE PREFERRED EMBODIMENT

Figure 1:
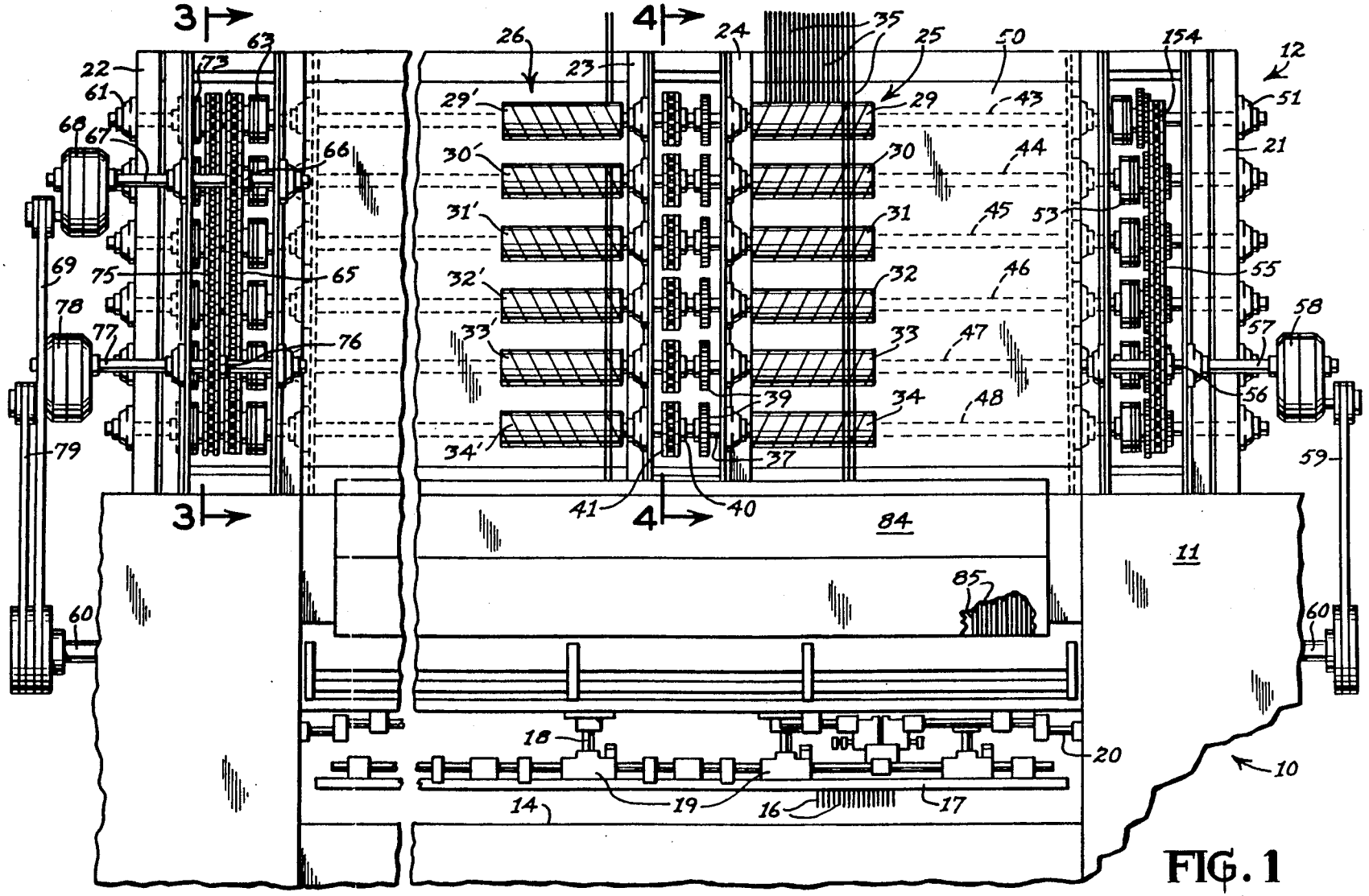
FIG. 1 is a fragmentary front elevation of a multiple needle tufting machine incorporating the yarn feed apparatus for tufting accent yarns in a patterned tufted pile fabric, in accordance with this invention, with portions broken away.
Figures 2, 3, 4, 5, 6:
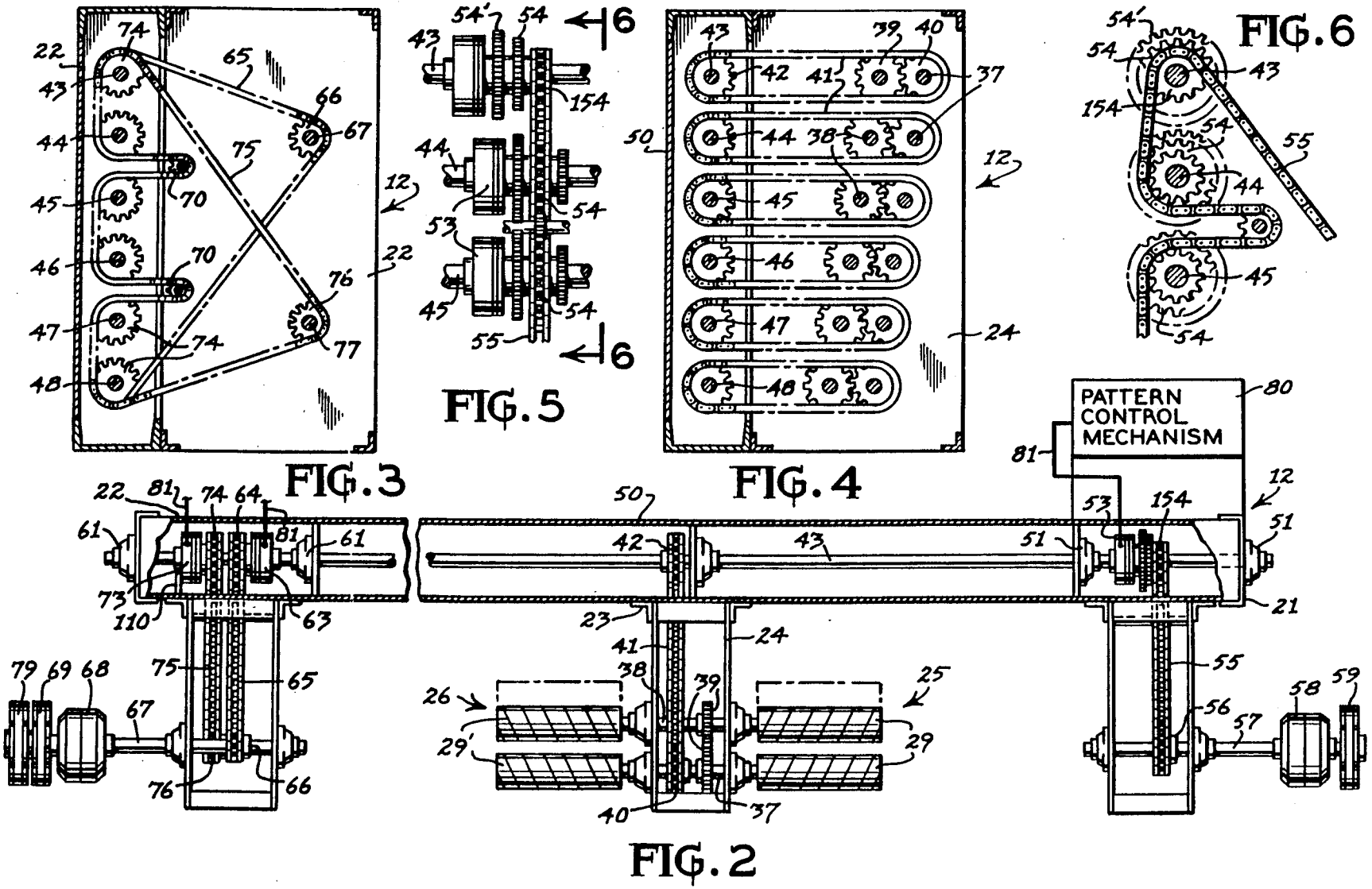
FIG. 2 is a top plan view of the yarn feed apparatus disclosed in FIG. 1, with portions broken away.
FIG. 3 is an elevational section taken along the line 3—3 of FIG. 1.
FIG. 4 is a sectional elevation taken along the line 4—4 of FIG. 1.
FIG. 5 is an enlarged, fragmentary front elevational view of the upper portion of the high speed clutch mechanism for the yarn feed apparatus disclosed in FIG. 1.
FIG. 6 is a fragmentary section taken along the line 6—6 of FIG. 5.

Referring now to the drawings in more detail, FIGS. 1 and 2 disclose a multiple needle tufting machine 10 made in accordance with this invention. The machine 10 includes a housing 11 incorporating the operating elements of the machine 10, which is substantially identical to the machine disclosed in the prior U.S. Pat. No. 4,864,946, except for details in the yarn feed mechanism 12. The machine 10, as best disclosed in FIG. 1, includes a bed frame 14 adapted to support a base fabric 15 (FIGS. 7–10) for movement through the machine and beneath the needles 16. The needles 16 are mounted on a transverse needle bar 17 which is adapted to be vertically reciprocably moved by push rods 18.

The needle bar 17 may be slidably shiftable in slide holders or feet 19 on the bottoms of push rods 18, by shift rods, such as the shift rod 20, controlled by pattern-controlled shift mechanisms, not shown, in the manner described in the R. T. Card U.S. Pat. No. 4,366,761. The needle bar 17 may be shifted in accordance with the predetermined pattern in order to form various types of geometric or graphic designs in the base fabric 15, in a well known manner.

The needles 16 are adapted to cooperate with corresponding hooks in a looper mechanism, not shown, in a well known manner, such as disclosed in the U.S. Pat. No. 4,864,946. Either a loop pile looper mechanism or a cut pile looper mechanism may be utilized in a well known manner.

The yarn feed mechanism 12 made in accordance with this invention, and as best disclosed in FIGS. 1 and 2, includes a right clutch housing 21 and a left clutch housing 22, mounted at each end of the machine 10 and supported in any convenient manner upon the top of the machine housing 11.

Mounted upon the front of the machine 10 by brackets 23 affixed to the upper portions of the machine housing 11 are a plurality of transversely spaced yarn feed supports or support housings 24, only one of which is shown in the drawing, but which will be mounted and spaced as shown in prior U.S. Pat. No. 4,864,946. Supported upon the exterior of the opposite side walls of each support housing 24 is a right bank or set 25 of yarn feed rolls and a left bank or set 26 of yarn feed rolls, each yarn feed roll projecting outward away from its corresponding housing 24 and terminating in a free unobstructed end.

As disclosed in FIGS. 1 and 2, the right bank 25 includes a plurality of vertically spaced yarn feed stub rolls, such as the six pair of feed rolls 29, 30, 31, 32, 33, and 34. The yarn feed rolls in each pair 29–34 are preferably mounted parallel to each other in the same horizontal plane and spaced apart front-to-rear just sufficiently to provide an adequate wrap for each corresponding set of yarns 35.

The left bank or set of feed rolls 26 includes yarn feed rolls identical in size, number and spacing to the yarn feed rolls in the right bank and are identified by the same reference numerals with primes, such as the yarn feed rolls 29', 30', 31', 32', 33', and 34'. However, the left bank rolls, e.g. 29', project from the common support 24 in the opposite direction from the right bank rolls, e.g. 29, and terminate in free unobstructed ends. Moreover, the left bank feed rolls are rotatably mounted in coaxial alignment with their corresponding yarn feed rolls, e.g. 29, in the right bank 25.

Moreover, in a preferred form of the invention, each of the corresponding yarn feed rolls on opposite sides of the housing 24 are not only coaxially aligned, but are mounted on common driven roll shafts 37 and 38. Thus, the top front yarn feed roll 29 in the right bank 25 is fixed to and mounted upon the same roll shaft 37 as its coaxially aligned counter-part front feed roll 29' in the left bank 26. In the same manner, the top rear yarn feed roll 29 is mounted on the same common shaft 38 as its corresponding left top rear yarn feed roll 29'.

The corresponding pairs of yarn feed rolls in each bank 25 and 26 are cooperatively connected together for simultaneous rotary motion at the same speed in opposite directions by transmissions, such as the cooperating reversing gears 39 fixed upon the corresponding common shafts 37 and 38, as illustrated in FIG. 2.

Fixedly attached to each common shaft 37 is a driven sprocket 40 coupled by a chain 41 to a drive sprocket 42. Each drive sprocket 42 is keyed to, or otherwise fixed to, a corresponding elongated yarn feed drive shaft 43, 44, 45, 46, 47, and 48. Each of the yarn feed drive shafts 43–48 extend through and are journaled for rotation within a drive shaft housing 50 in alignment with the right and left clutch housings 21 and 22 and immediately behind the yarn feed supports 24.

The right end portion of each of the yarn feed drive shafts 43–48 extends through the right clutch housing 21 and is journaled in bearings 51.

The right end portion of each of the yarn feed drive shafts 43–48 carries a high-speed electromagnetic clutch 53 adapted to engage, when electrically energized, a driven sprocket 54 or 154 coupled by chain 55 to a drive sprocket 56 rigidly keyed upon a driven shaft 57 driven through a reduction gear 58 by a belt transmission 59 from the main drive shaft 60. The chain 55 may be one chain connecting the drive sprocket 56 with all of the driven sprockets 54 and 154, and may be arranged in any type of loop arrangement including idler gears.

In a similar manner, the left end portions of the yarn feed drive shafts 43–48 extend through the left clutch housing 22 and are journaled in the bearings 61.

Each of the yarn feed drive shafts 43–48 carries and cooperates with a low-speed electromagnetic clutch 63, each of which is adapted to engage when electrically energized, a driven sprocket 64, which in turn is linked through chain 65 to a drive sprocket 66 on a driven shaft 67. The driven shaft 67 is driven through a reduction gear 68 by a belt transmission 69 from the main drive shaft 60. The drive sprocket 66 may be coupled to all of the driven sprockets 64 for all six shafts by the same chain 65, as illustrated in FIGS. 1, 2, and 3. As disclosed in FIG. 3, the chain 65 may be trained about idler sprockets immediately behind the idler sprockets 70 disclosed in FIG. 3.

The parts thus far described in the machine 10 are essentially identical to those disclosed in the tufting machine disclosed in U.S. Pat. No. 4,864,946.

The machine 10, made in accordance with this invention, further includes a minimal speed or braking electromagnetic clutch 73 also carried on the left end portion of each of the yarn feed drive shafts 43–48. Each of the braking clutches 73 are adapted to engage, when electrically energized, a driven sprocket 74 coupled by chain 75 to a drive sprocket 76 rigidly keyed upon a driven shaft 77. The driven shaft 77 is driven through a reduction gear 78 by a belt transmission 79 to the same main drive shaft 60.

Figure 10:
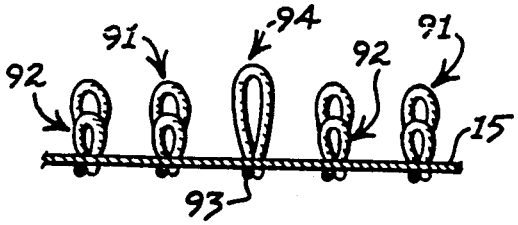
FIG. 10 is an enlarged fragmentary section taken along the line 10—10 of FIG. 7.

Each of the electromagnetic clutches 53, 63, and 73 may have the same structure as the electromagnetic clutch disclosed in FIG. 10 of the prior Watkins U.S. Pat. No. 4,864,946. The clutches 53, 63, and 73 may be identical in structure but the size or the number of gear teeth in the driven or drive sprockets may be different in order to provide the particular speed for that clutch and ultimately the speed of the yarn feed rolls driven by the corresponding drive feed shafts.

The electromagnetic coils of each of the clutches 53, 63, and 73 may be connected to a pattern control mechanism 80 through leads 81 (FIG. 2). The pattern control mechanism 80 may be pre-programmed in any desired manner, in order to selectively energize certain high speed, low speed, and braking speed clutches, which in turn drive the yarn feed rolls at desired speeds, either high speed, low speed, or minimal speed. The pattern control mechanism 80 may be of any desired construction, such as that disclosed in the Roy T. Card U.S. Pat. No. 3,075,482 for "Three-Level Tufted Pile Fabric", or any more sophisticated pattern control mechanisms currently used, such as a computer controlled pattern mechanism.

As disclosed in FIG. 1, the yarns 35 are fed in separate sets to each bank of yarn feed rolls on the right and left sides of each of the support housings 24. In each bank of yarn feed rolls, each set of yarns is threaded about a corresponding pair of cooperating yarn feed rolls, such as the pair 29. Each set of yarns 35 is wrapped around the bottom of the rear yarn feed roll, such as 29, and then wrapped around the upper surface of the front yarn feed roll, such as 29, in each pair, until each set of yarns is wrapped around its corresponding pair of rolls 29–34 and 29'–34', for each of the support housings 24.

The yarns 35 from all six sets of yarns in each bank are then fed through a separate yarn feed tube bank 84, each of which includes a separate housing and a plurality of yarn guide tubes 85. The yarns are threaded in the same manner through the yarn feed tube bank 84 as they are in the prior U.S. Pat. No. 4,864,946. Preferably there is a separate yarn tube bank 84 for each of the vertical banks of yarn feed rolls incorporated in the machine 10.

It will be noted in the drawings, that each of the high speed clutches 53 is provided with a set of triple sprockets, including the middle sprocket 54 which is sandwiched between a smaller sprocket 154 and a larger sprocket 54'. When the chain 55 is trained about the middle sprockets 54, the yarn feed rolls controlled by the corresponding high-speed clutch 53 are driven at a high speed to form normal high pile loops. When the chain 55 is trained about the small sprocket 154, the corresponding yarn feed roll is driven at a slightly faster speed than the middle sprocket 54. If the larger sprocket 54 is driven by the chain 55, the corresponding yarn feed roll will be driven at a slightly slower speed than if driven by the middle sprocket 54.

As disclosed in the drawings, and particularly FIGS. 1, 5, and 6, the chain 55 has been shown as trained about all of the middle sprockets 54, except the top drive shaft 43. For the top high-speed clutch 53 on drive shaft 43, the chain 55 is trained about the small extra high-speed or over-feed sprocket 154. Thus, as disclosed in the drawings, only the accent yarns are fed in transversely spaced repeat longitudinal rows of stitching from the top yarn feed rolls 29.

The pattern control mechanism 80 is programmed in such a manner as to produce a desired pattern in a tufted pile fabric in which the pile loops at various locations will be formed at either a normal low pile or a normal high pile, and only the accent yarns will periodically form braked or starved minimal level pile lower than the normal low pile, and an overfed high pile higher than the normal high pile.

Figure 7:
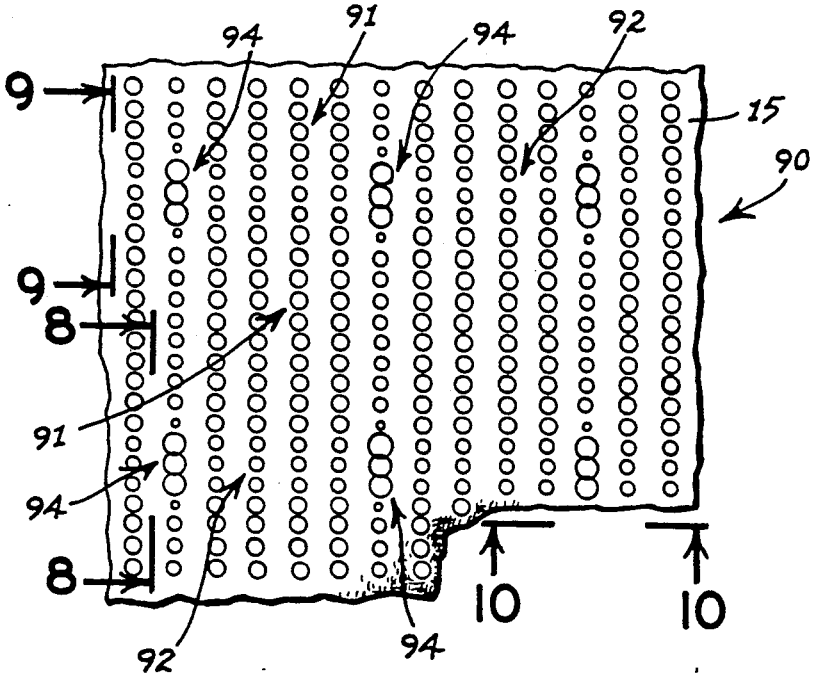
FIG. 7 is a fragmentary plan view of a tufted pile fabric made in accordance with this invention, in which the various height tufts are represented by circles of different sizes.

One example of a tufted pile fabric formed in accordance with this invention and incorporating one particular design including four pile heights is disclosed in FIG. 7. The pile fabric 90 disclosed in FIG. 7 includes a pattern incorporating a plurality of longitudinally and horizontally aligned substantially square background areas 91 of high pile. The background areas 91 are delineated or defined by transverse rows of low loop pile 92 and longitudinal rows of accent yarns 93. At the corners of each of the square background areas 91 high level accent pile loops 94 are formed.

Since all of the yarns 35 which form the background areas 91 are threaded about the banks of yarn feed rolls 30–34 and 30'–34', in accordance with this example, the yarns in the background area are capable of being formed at either the normal high pile, the normal low pile or the minimal pile. However, in the example illustrated, the pattern control mechanism is programmed so that the brake clutches 73 will not be activated for any of the yarn feed rolls 30–34 or 30'–34'. Accordingly, the background areas 91 will be formed of normal high pile loops because the high speed clutches 53 controlling the background area have their middle sprockets 54 driven by the high speed chain 55. The transverse rows of low loop pile 92 will be formed of normal low loop because when the needles are forming the transverse low loops, the low-speed clutches 63 will be engaged for these particular yarn feed rolls 30–34 and 30'–34'.

On the other hand, the yarns 35 trained about the top yarn feed rolls 29 and 29' are capable of being formed at the overfed high level, and are also capable of forming the normal low loops and the minimal loops, when controlled by the braking clutches 73.

Figure 11:
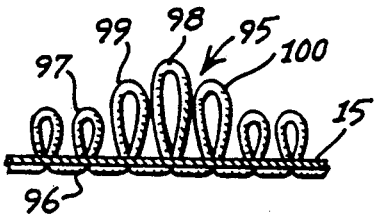
FIG. 11 (PRIOR ART)
FIG. 11 is a fragmentary sectional elevation similar to FIG. 8, but showing accent pile loops formed in accordance with the prior art.

As disclosed in FIG. 11, if it is attempted to form a high pile accent loop in a base fabric 15 with a conventional multiple needle tufting machine incorporating only controls for forming high pile and low pile, such as the prior U.S. Pat. No. 4,864,946, a non-uniform high accent pile cluster of loops 95 is formed. When the base fabric 15 is moving through the machine and the accent yarn 96 is forming low loops of normal low level 97, and the pattern mechanism converts the low pile control to high pile control, the pile loops are gradually increased in height, rather than increasing abruptly, because of yarn stretch, delay in clutch torque buildup, and other factors, so that no uniform high accent pile is obtained. As illustrated in FIG. 11, the prior art cluster 95 of three accent loops includes a single middle high loop 98 flanked by a pair of intermediate high loops 99 and 100, of lesser height than the middle accent loop 98. The appearance of a plurality of such clusters 95 of uneven high pile is unsatisfactory in a completed carpet.

Figure 8:
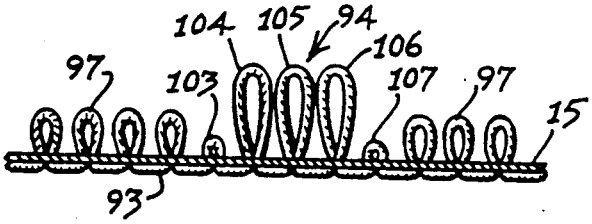
FIG. 8 is an enlarged fragmentary section taken along the line 8—8 of FIG. 7.

As illustrated in FIG. 8, the accent pile yarn 93 is tufted through the base fabric 15, in accordance with this invention, in order to form the normal low loop piles 97, in the same manner as they were formed in the fabric disclosed in FIG. 11. However, immediately before the formation of the high accent cluster 94, the accent yarn 93 is braked by energization of its corresponding braking clutch 73, which either immediately stops the rotation of the corresponding yarn feed rolls 29 and 29', or reduces the speed of these rolls to such a minimum speed that minimal loops 103 are formed which are substantially buried in the base fabric 15. After one stitch forming the minimal loop 103, the extra high-speed clutch 53 controlling the feed rolls 29 and 29' is immediately energized to over-drive the feed rolls 29 and 29' at a slightly greater speed than the high speed of the remaining rolls 30–34 or 30'–34'. Such overfeeding of the accent yarn 93 preceded by the substantial burying of the minimal loops 103 immediately thrusts upward a first loop 104 and subsequent loops 105 and 106 in the cluster 94 which are substantially of uniform high pile, at least as high as the high pile loops of the background area 91. After the desired number of accent loops 104, 105, and 106 have been formed, at the overfeed yarn speed rate of the top high-speed clutch 53 with the small sprockets 154, the braking clutch 73 is again energized to form another minimal loop 107 which is substantially buried in the base fabric 15 as is the minimal loop 103. Then the low loop pile clutches 63 are energized to drive the yarn feed rolls 29 and 29' at their regular and normal low speed to form the normal low loop piles 97.

One method of braking the clutches 73 is to lock the rotary armature of the clutch 73 to the stationary wall of the clutch housing 22 by a locking bar or bracket 110 (FIG. 2).

Thus, the high accent cluster 94, because of its unique formation in the overfeeding of the accent yarn 93 to form the uniform high loops 104, 105, and 106, as well as the starving of the yarn 93 to form the loops 103 and 107 on opposite sides of the cluster 94, present a high degree of contrast between the high accent clusters 94, wherever they appear, and the background pile areas 91.

It is also within the scope of this invention to form the pile fabric 90 without the transverse rows of low loop pile 92. Thus, although the appearance of square patterns will not appear, nevertheless, the high accent clusters 94 are still completely surrounded by a high pile area such as 91. The starving of the loops to form the minimal low loops 103 and 107 also accentuate the overfed pile height of the accent cluster 94.

In actual practice, each intermediate sprocket 54 has 32 teeth, while the smaller overfeed sprocket 154 has 30 teeth. Therefore, the overfeed sprocket 154 is feeding a yarn increment or stitch length about 6⅔% longer than a yarn increment simultaneously fed by an intermediate sprocket 54. When the yarn increments are doubled to form loops or tufts, then the theoretical difference in pile height between the high pile accent loop and the normal high pile loop is approximately 3½%. Such a small difference in pile height is not usually perceived by the casual observer, even if the theoretical difference in pile height is attained. Hence, the accent clusters 94 appear to be about the same level as the high pile tufts 91.

Even though the accent clusters 94 appear to the casual observer to be approximately the same level as the regular or normal high pile tufts 91 in the background field of the tufted fabric, nevertheless, the accent clusters 94 present a sharper distinction from the high pile background field than accent loops previously formed at normal high pile elevation.

It is believed that in some instances the accent tufts or loops 94 are actually slightly higher than the normal high pile loops 91. In other instances, the overfeed yarn increment may be buried in the base fabric 15 or elsewhere in the stitch. Such burying is caused by the yarn stretching or by inertia in the delayed development of the full torque on the magnetic clutches.

Figure 9:
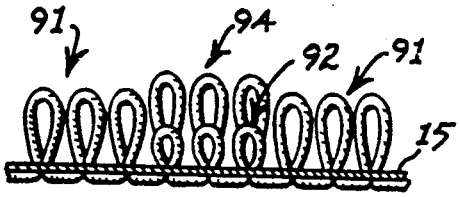
FIG. 9 is an enlarged fragmentary section taken along the line 9—9 of FIG. 7.

FIGS. 9 and 10 disclose other sections taken through the pile fabric 90 in order to further illustrate the definition of the high accent cluster 94. However, the height of the accent loops 94 has been exaggerated for emphasis on the distinction between the high accent loops 94 and the normal high pile loops 91.

It is also within the scope of this invention to form the patterned pile fabrics, such as 90, in accordance with this invention in the form of cut pile, as well as loop pile. Furthermore, the overfed high level accent clusters may be further emphasized by utilization of yarn of different colors from the background area.

Moreover, it is within the scope of this invention to laterally shift the needle bar 17, whether the needle bar includes in-line needles or staggered needles, in order to form other pile fabric patterns. Regardless of the mechanism for making the fabric, nevertheless, because of the unique formation of the high pile clusters 94, these clusters are finely accented or delineated in the surrounding background pile areas.

By having the additional sprocket 54' on each of the high-speed clutches 53, the capability of forming high pile yarns at three different levels in different yarns in different parts of the fabric is attained.

It is also within the scope of this invention to provide high accent clusters 94 of more or less yarns than the three loops 104, 105, and 106 disclosed in the drawings. It is possible to form a single high accent yarn flanked by a pair of minimal loops 103 and 107. It is also possible to form more than three loops flanked by the minimal loops 103 and 107 in the same accent yarn 93.

It is therefore apparent that a multiple needle tufting machine including yarn feed controls, each of which is adapted to form three different heights of loop pile in background rows of yarns and three different heights of loop pile, including an extra high pile in rows of accent yarns, has been designed which is capable of producing four or more levels of pile in a tufting pile fabric in order to produce highly delineated accent clusters of tufts in various locations according to predetermined patterns.

What is claimed is:

1. A method of forming accent yarn in a tufted pile fabric comprising the steps of:

(a) stitching a plurality of transversely spaced longitudinal background rows of background pile yarn through a base fabric to form pile loops of predetermined pile heights on one side of said base fabric to form a background pile area, (b) stitching adjacent said background pile area a longitudinal accent row of accent yarn to form low pile loops of a height lower than the highest pile height in said background pile area;

(c) also forming in said one longitudinal row of accent yarn at predetermined intervals, sequentially at least one first pile loop of a height substantially less than the height of said low pile loops, at least one accent pile loop of a height at least as great as any of said predetermined pile heights, and at least one second pile loop of a height substantially the same as the height of said first pile loop.

2. The method according to claim 1 further comprising the step of feeding said accent yarn at a predetermined feed rate to form said low pile loops, braking said feeding of said accent yarn to form said first and second pile loops, and over-feeding said accent yarn at an over-feed rate substantially greater than said predetermined feed rate to form said accent pile loop between said first and second pile loops.

3. The method according to claim 2 further comprising the step of feeding said background pile yarn adjacent said longitudinal row of accent yarn at predetermined rates to form said pile loops in said background pile area at heights below the height of said accent pile loop.

4. The method according to claim 3 further comprising the step of forming low pile loops, of substantially the same height as said low pile loops in said accent row, in a transverse row transverse to said accent row and intersecting said accent pile loop.

5. The method according to claim 4 further comprising the step of forming a second longitudinal accent row of pile loops spaced from said one accent row, said background rows being between said one accent row and said second accent row, forming in said second accent row, sequentially a first pile loop, an accent pile loop, and a second pile loop identical to said corresponding pile loops in said one accent row, said transverse row intersecting both said accent pile loops in said one accent row and said second accent row.

6. In a multiple needle tufting machine having means for feeding a base fabric longitudinally from front-to-rear through the machine, and a transverse row of a plurality of spaced needles aligned transversely of the machine for reciprocal movement through the base fabric for carrying yarn through the base fabric in order to form pile loops, an apparatus for tufting accent yarns in said base fabric comprising:

(a) a plurality of yarn feed rolls for feeding yarns to said needles, (b) low-speed drive means operatively connected to each of said yarn feed rolls for selectively driving each of said yarn feed rolls at a predetermined low speed to produce low pile loops in said base fabric at a predetermined low pile height, (c) braking means operatively connected to each of said yarn feed rolls for selectively braking each of said yarn feed rolls to a predetermined minimal speed to produce first and second minimal pile loops in said base fabric of a lesser height than said low pile height, (d) extra high-speed drive means operatively connected to a first set of said yarn feed rolls for selectively driving said first set of said yarn feed rolls at a predetermined extra high speed to produce high accent loops in said base fabric of a pile height at least as great as a predetermined normal high pile level, (e) high-speed drive means operatively connected to each of said yarn feed rolls, other than said first set, for selectively driving each of said yarn feed rolls, other than said first set, at a predetermined high speed less than said extra high speed to produce high pile loops of a height substantially equal to a predetermined normal high pile level, the height of said normal high pile level being greater than said low pile height, (f) pattern control means operatively connected to said low speed drive means, to said braking means, to said extra high-speed drive means, and to said high-speed drive means, whereby only one of said drive means or braking means operatively drives any corresponding one of said yarn feed rolls at any one time, and (g) said pattern control means further comprising means for producing a plurality of longitudinal rows of pile loops in said base fabric in which one of said longitudinal rows includes in sequence, at least one of said first minimal pile loops, at least one high accent loop, and at least one minimal second pile loop.

7. The tufting machine according to claim 6 wherein said pattern control means further comprises means for actuating said braking means to produce at least one of said first minimal pile loops in said one row and immediately actuate said extra high-speed drive means to drive said first set of yarn feed rolls to draw extra yarn from said first minimal pile loop to create said high accent loop.

8. The tufting machine according to claim 7 wherein said first set of yarn feed rolls feeds an accent yarn to said one longitudinal row in which only low pile loops, minimal pile loops, and high accent loops are formed, and in which a different set of yarn feed rolls feeds other background yarns to the other longitudinal rows of pile loops in which only low pile loops and high pile loops are formed.

9. The tufting machine according to claim 6 further comprising a plurality of sets of said yarn feed rolls, including said first set, a yarn feed drive shaft for each of said sets, extending transversely substantially across said machine, transmission means for drivingly connecting each of said yarn feed drive shafts to corresponding yarn feed rolls, said high-speed drive means comprising high-speed clutch means on one end of each of said drive shafts, said low-speed drive means comprising low-speed clutch means on an end of each of said drive shafts, said braking means comprising a brake clutch means mounted on an end of each of said drive shafts, said extra high-speed drive means comprising a high-speed clutch means in combination with an over-feed device for driving said first set of yarn feed rolls at said predetermined extra high speed, said pattern control means being operatively connected to each of said clutch means for selectively energizing only one of said clutch means on any one drive shaft at a time.

10. The tufting machine according to claim 8 wherein said low-speed clutch means and said brake clutch means are both mounted on the opposite end of each of said drive shafts from said high-speed clutch means.

* * * * *